US011071683B2

(12) United States Patent
Ray

(10) Patent No.: US 11,071,683 B2
(45) Date of Patent: Jul. 27, 2021

(54) PERSONAL SEX TOY

(71) Applicant: William Jaimie Ray, Albany, LA (US)

(72) Inventor: William Jaimie Ray, Albany, LA (US)

( * ) Notice: Subject to any disclaimer, the term of this patent is extended or adjusted under 35 U.S.C. 154(b) by 217 days.

(21) Appl. No.: 16/356,307

(22) Filed: Mar. 18, 2019

(65) Prior Publication Data

US 2019/0282439 A1 Sep. 19, 2019

Related U.S. Application Data

(60) Provisional application No. 62/644,218, filed on Mar. 16, 2018.

(51) Int. Cl.
*A61H 19/00* (2006.01)

(52) U.S. Cl.
CPC ..... *A61H 19/44* (2013.01); *A61H 2201/1253* (2013.01); *A61H 2201/1664* (2013.01)

(58) Field of Classification Search
CPC ..... A61H 19/00; A61H 19/40; A61H 19/44; A61H 19/50; A61H 23/00
See application file for complete search history.

(56) References Cited

U.S. PATENT DOCUMENTS 6,422,993 B1 7/2002 Hudson
6,866,645 B2 3/2005 Lee
6,902,525 B1 6/2005 Jewell
7,104,950 B2 9/2006 Levy
7,175,592 B2 2/2007 Lee
7,267,646 B2 9/2007 Tucker
7,524,283 B1 * 4/2009 Johnstone, II ..... A61H 19/44 128/845
7,993,262 B2 8/2011 Cianfrani
8,313,424 B2 11/2012 Gabrielidis
9,072,651 B1 7/2015 Parker, Jr.
9,398,997 B2 7/2016 Lindholm
9,808,396 B2 11/2017 Ferrari et al.
2004/0260146 A1 * 12/2004 Cao ..... A61H 19/44 600/38
2005/0215852 A1 * 9/2005 Hatami ..... A61H 19/44 600/38
2007/0049851 A1 3/2007 Lin
2007/0203392 A1 * 8/2007 Jerstad ..... A61H 19/00 600/38
2008/0287733 A1 11/2008 Robinson
2012/0157893 A1 6/2012 Fang
2017/0105892 A1 * 4/2017 Epstein ..... A61G 5/0833
2017/0189263 A1 7/2017 Cambridge

* cited by examiner

*Primary Examiner* — John P Lacyk
(74) *Attorney, Agent, or Firm* — Dunlap Bennett & Ludwig, PLLC

(57) ABSTRACT

A personal sex toy includes vertical legs and a support body fixedly adjustable along a length of the vertical legs. Slide mount plates are coupled to the support body. The slide mount plates each include a linear slide support. A sliding rod includes a first end and a second end. The sliding rod is slidably engaged within the linear slide supports. A handle is coupled to the first end of the sliding rod. A phallic member is releasably coupled to the second end of the sliding rod.

11 Claims, 4 Drawing Sheets

PERSONAL SEX TOY

CROSS-REFERENCE TO RELATED APPLICATION

This application claims the benefit of priority of U.S. provisional application No. 62/644,218, filed Mar. 16, 2018, the contents of which are herein incorporated by reference.

BACKGROUND OF THE INVENTION

The present invention relates to a personal sex toy and, more particularly, to a quiet sex toy that is adjustable for use by the disabled.

Throughout history, humans have sought sexual gratification by artificial means. Such artificial means have included orifices to simulate male organs. Other artificial means have included phallic devices to facilitate vaginal or anal stimulation.

Current sex toys are noisy. Additionally, certain people with disabilities have difficulty with self-gratification or the process is so challenging it's not worth the effort.

As can be seen, there is a need for a quiet sex toy that is adjustable for use by the disabled.

SUMMARY OF THE INVENTION

In one aspect of the present invention, a personal sex toy comprises: vertical legs; a support body fixedly adjustable along a length of the vertical legs; slide mount plates coupled to the support body, the slide mount plates each comprising a linear slide support; and a sliding rod comprising a first end and a second end, the sliding rod slidably engaged within the linear slide supports; a handle coupled to the first end of the sliding rod.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
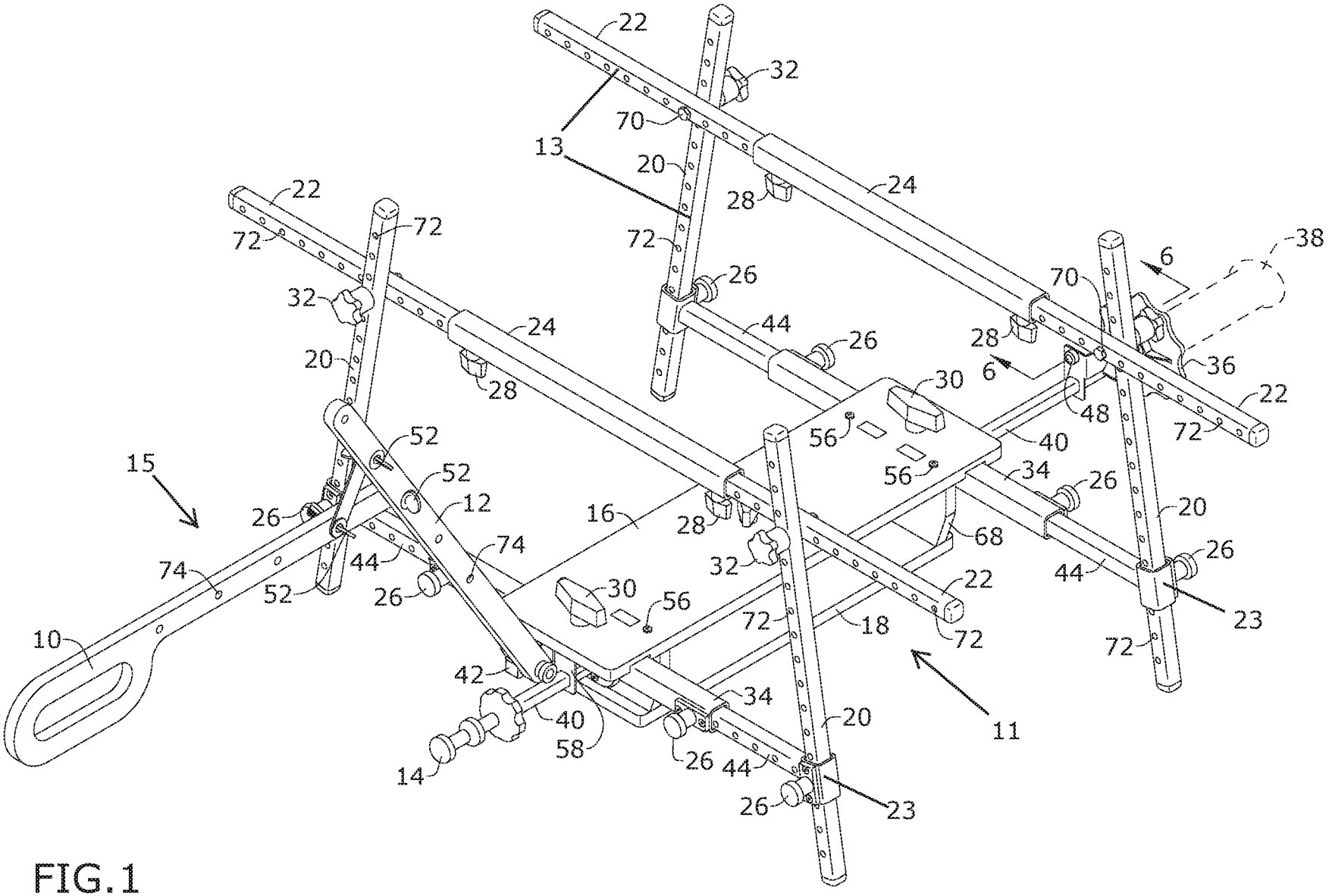
FIG. 1 is a perspective view of an embodiment of the present invention.
Figure 2:
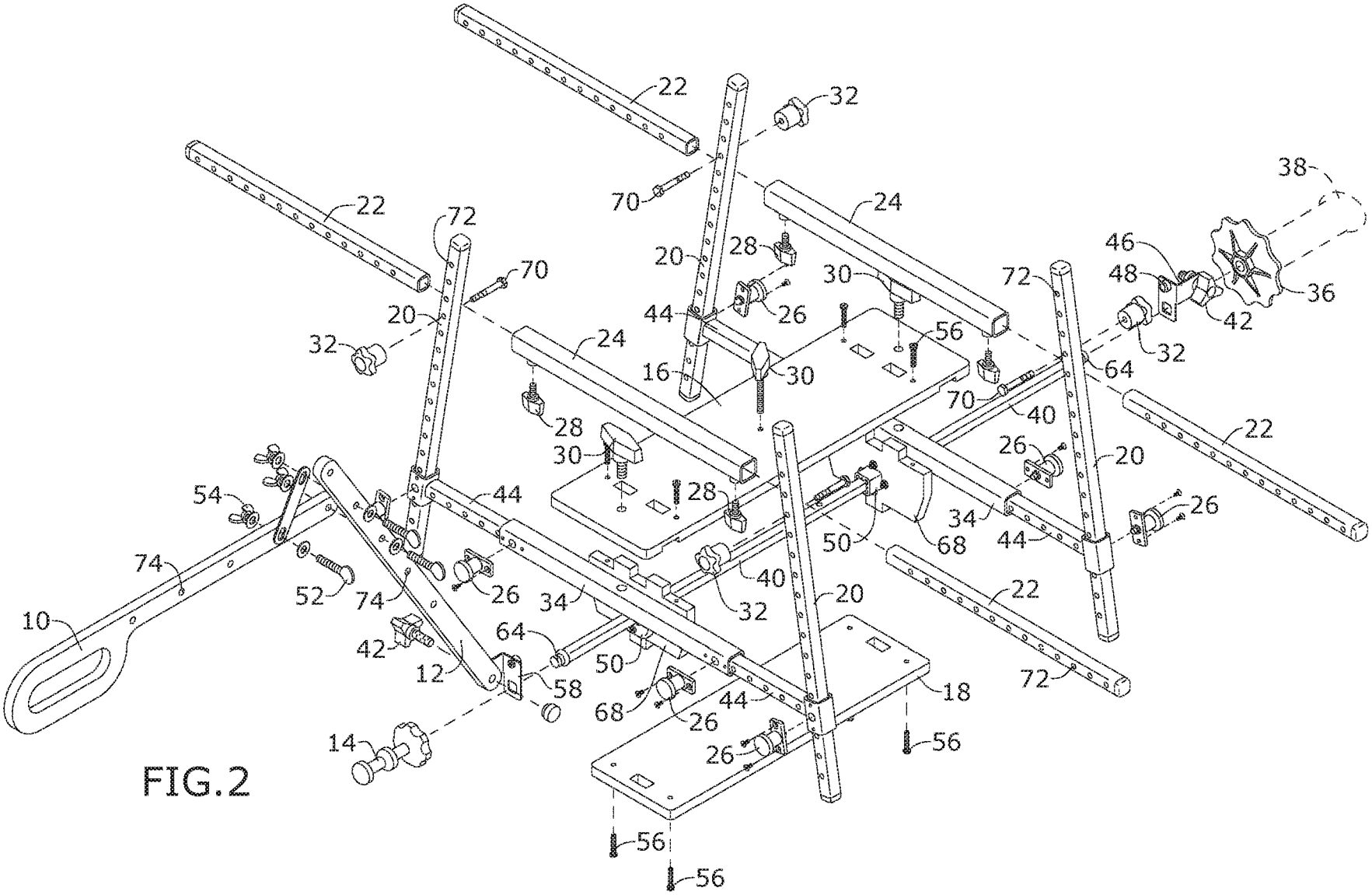
FIG. 2 is an exploded view of an embodiment of the present invention.
Figure 3:
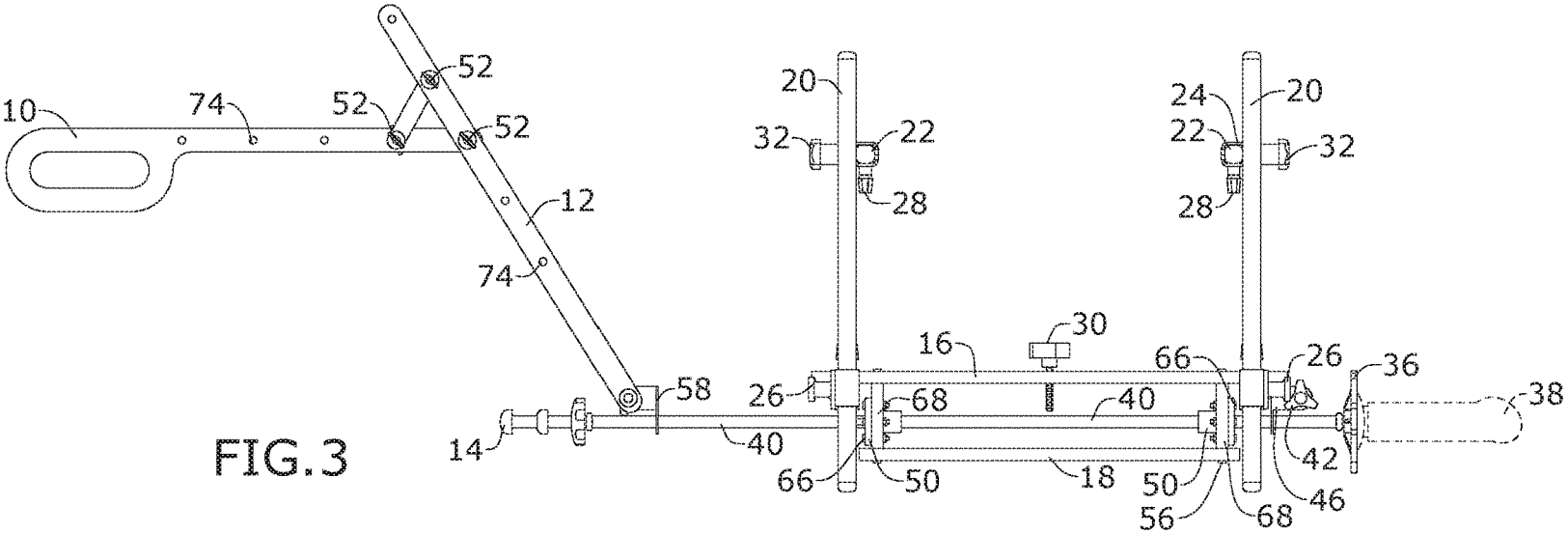
FIG. 3 is a side view of an embodiment of the present invention.
Figure 4:
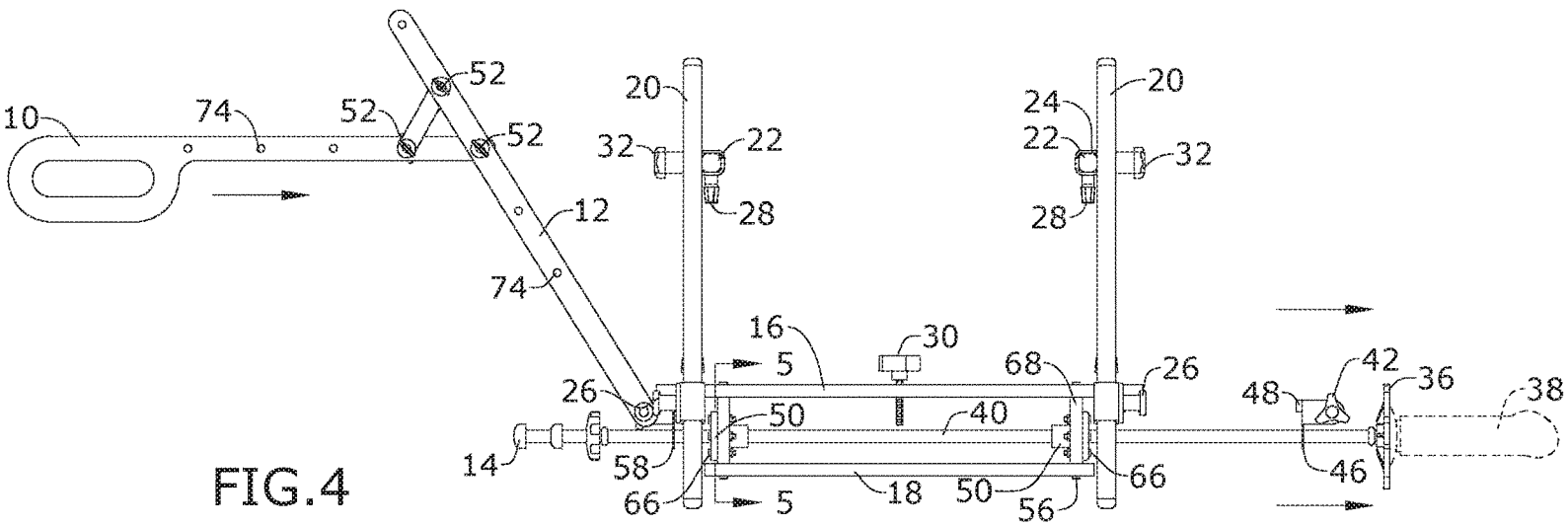
FIG. 4 is a side view of an embodiment of the present invention in an engaged position.
Figure 5:
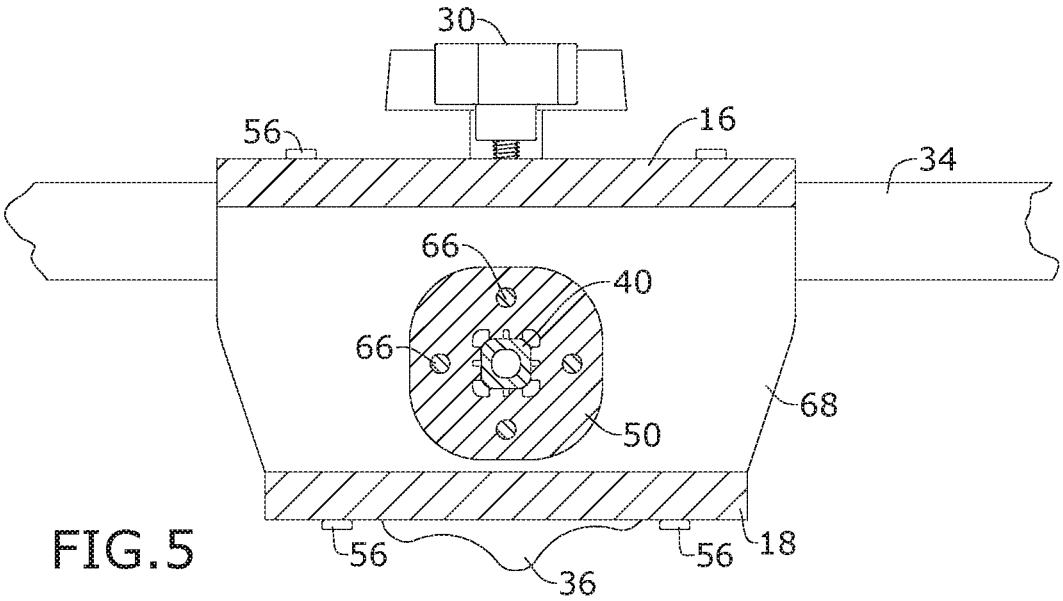
FIG. 5 is a section view of the present invention, taken along line 5-5 in FIG. 4.
Figure 6:
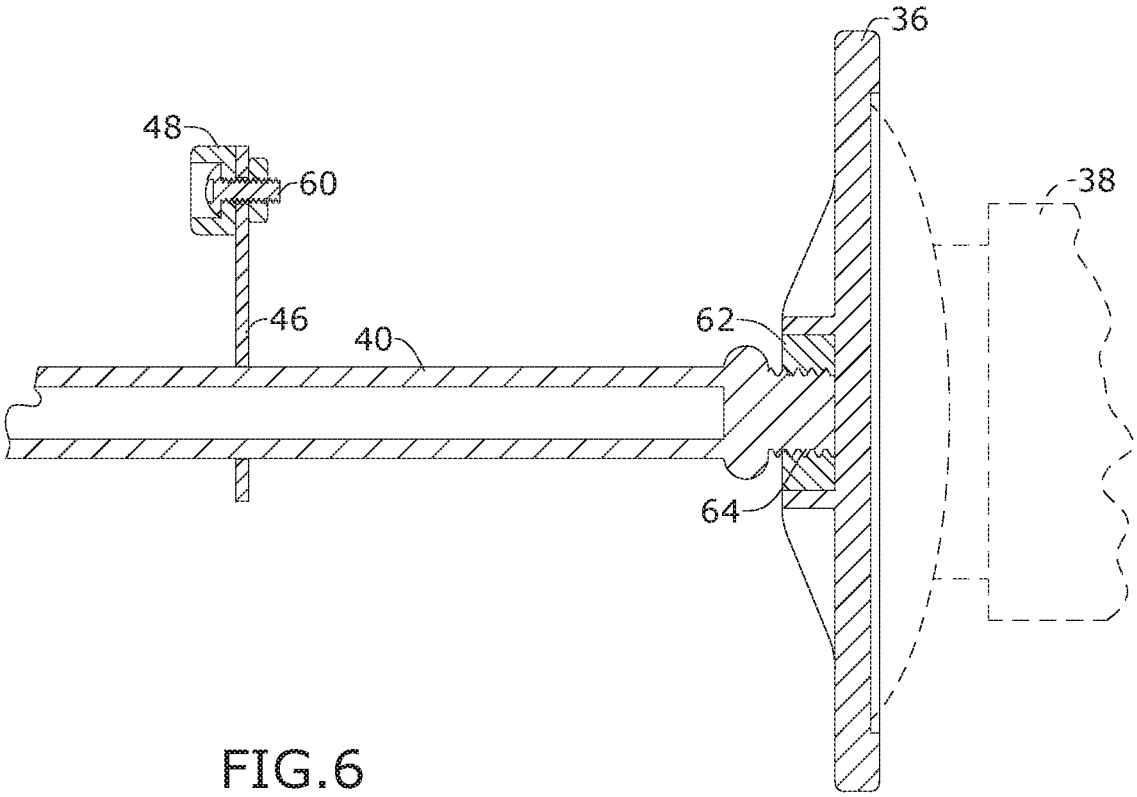
FIG. 6 is a section view of the present invention, taken along line 6-6 in FIG. 1.

Referring to FIGS. 1 through 6, the present invention includes a personal sex toy. The personal sex toy includes vertical legs 20 and a support body 11 fixedly adjustable along a length of the vertical legs 20. Slide mount plates 68 are coupled to the support body 11. The slide mount plates 68 each include a linear slide support 50. A sliding rod 40 includes a first end and a second end. The sliding rod 40 is slidably engaged within the linear slide supports 50. The sliding rod 40 may include a square tube shape. A handle 15 is coupled to the first end of the sliding rod 40. A phallic member 38 is releasably coupled to the second end of the sliding rod 40. Alternatively, an artificial vagina may be releasably coupled to the second end of the sliding rod 40.

The support body 11 includes a front horizontal base support and a rear horizontal base support 44. Each of the front and rear horizontal base supports 44 include adjustable outer arms and a central support 34. The adjustable outer arms include openings 72 disposed along the length and outer slide brackets 23. The central support 34 includes openings at opposing ends. The adjustable outer arms slidably fit within the openings of the opposing ends. Spring plungers 26 are coupled to the opposing ends of the central support 34. The spring plungers 26 include a spring biased pin that fits within openings 72 of the adjustable arms and lock the adjustable arms in place relative to the central support 34. Additionally, each of the outer slide brackets 23 include spring plungers 26. The spring plungers 26 of the outer slide brackets 23 also include the spring biased pin that fits within openings 72 of the vertical legs 20 and lock the horizontal base supports 44 relative to the vertical legs 20. The front horizontal base support and a rear horizontal base support 44 are fixed at an 18.5 degree angle relative to the vertical legs.

The support body 11 may further includes a top support plate 16 and bottom support plate 18. The central supports 34 and the slide mount plates 68 are coupled in between the top support plate 16 and the bottom support plate 18. The support plates 16, 18 couple the front and rear horizontal base supports 44 together by the threaded arm knobs 30 disposed at opposing ends of the support body 11. A central threaded arm knob 30 may drive into a threaded opening of the sliding rod 40, locking the sliding rod 40 in place relative to the support body 11. As mentioned above, the slide mount plates 68 are coupled in between the top support plate 16 and the bottom support plate 18. Screws 56 couple the side mount plates 68 to the top support plate 16 and the bottom support plate 18. The linear slide supports 50 are coupled to the slide mount plates 68 by screws 66.

The present invention includes support legs 13. The support legs 13 include the vertical legs 20 and front and rear leg couplers. The vertical legs 20 include a plurality of openings 72 along the length. As mentioned above, the vertical legs 20 are slidably disposed within the outer slide brackets 30 and are locked to the outer slide brackets 30 by the spring plungers 26. The front and rear leg couplers each include adjustable outer horizontal arms 22 each having openings 72 disposed along a length. The front and rear leg couplers each further include central supports 24 having openings at opposing ends. The adjustable outer arms 22 slidably fit within openings of the opposing ends of the central support 24. Threaded arm knobs 28 fit through aligned openings 72 of the central supports 24 and the adjustable outer arms 22, coupling them together. Threaded arm knobs 32 and bolts 70 fit through aligned openings 72 of the adjustable outer arms 22 and the vertical legs 20, coupling them together.

The present invention further includes a sliding member. The sliding member includes the sliding rod 40, the handle 15, and a personal portion. The sliding rod 40 is slidably disposed within the linear slide supports 50 of slide mount plates 68. The sliding rod 40 further includes a threaded first end 64 and a threaded second end 64. A first bumper bracket 58 is coupled to the first end of the sliding rod 40. The first bumper bracket 58 includes a rubber bumper 48 configured to engage the support body 11 when the handle 15 is pushed forward. A second bumper bracket 46 is coupled to the second end of the sliding rod 40. The second bumper bracket 46 includes a rubber bumper 48 configured to engage the support body 11 when the handle 15 is pulled backwards.

The handle 15 includes a vertical handle support 12 and a horizontal handle support 10. An angle between the vertical handle support 12 and the sliding rod 40 is adjustable and the angle between the vertical handle support 12 and the horizontal handle support 10 is adjustable. The vertical handle support 12 includes a bottom end coupled to the bumper bracket 58 by a threaded arm knob 42. The bumper bracket 58 is coupled to the sliding rod 40 by a threaded knob 14. The vertical handle support 12 includes a plurality of openings 74 along the length. The horizontal handle support 10 also includes a plurality of openings 74 along length. The horizontal handle support 10 is coupled to the vertical handle support 12 by screws 52 running through aligned openings 74 and wing nuts 54 threadably coupled to the screws 52.

The personal portion includes a plate 36 threadably coupled to the threaded second end 64 of the sliding rod 40 by a plate nut 62. The phallic member 38 is releasably coupled to the plate 36. The bumper bracket 46 is coupled to sliding rod 40 before the plate 36 by an arm knob 42. The rubber bumper 48 is coupled to the bumper bracket 46 by a screw 60.

The front and rear horizontal base supports 44, the vertical legs 20, and the leg couplers are each adjustable at about one to two inch increments and spans as far as twelve to twenty four inches in width and height. The present invention may be adjusted to setup in numerous different positions to be used in many different ways, on a chair, bed, floor, standing, wheelchair and the like. The handle 15 is used to slide the sliding rod 40 back and forth so that the phallic member 38 moves at a desired speed and depth of the users choosing, in and out of their desired body location. Additionally, the present invention does not use electrical power and is nearly silent.

It should be understood, of course, that the foregoing relates to exemplary embodiments of the invention and that modifications may be made without departing from the spirit and scope of the invention as set forth in the following claims.

What is claimed is:

1. A personal sex toy comprising:

vertical legs;

a support body fixedly adjustable along a length of the vertical legs, said support body comprising slide mount plates, each comprising a linear slide support;

a sliding rod comprising a first end and a second end, the sliding rod slidably engaged within the linear slide supports;

a handle coupled to the first end of the sliding rod; and an end plate threadably coupled to the second end of the sliding rod.

2. The personal sex toy of claim 1, wherein the support body further comprises:

front and rear horizontal base supports each comprising: outer arms each comprising an outer slide bracket; and a central support, wherein the outer arms are fixedly adjustable along a length of the central support, and the outer slide brackets are each fixedly adjustable along the length of a corresponding vertical leg of the vertical legs.

3. The personal sex toy of claim 2, wherein the plurality of vertical legs each comprise a plurality of openings, and the outer slide brackets each comprise a spring plunger each comprising a pin sized to fit within the plurality of openings.

4. The personal sex toy of claim 2, wherein the support body further comprises:

a top support plate and a bottom support plate, wherein the central supports and the slide mount plates are coupled in between the top support plate and the bottom support plate.

5. The personal sex toy of claim 1, further comprising a first bumper bracket coupled to the first end of the sliding rod, the first bumper bracket comprising a rubber bumper configured to engage the support body when the handle is pushed forward, and a second bumper bracket coupled to sliding rod adjacent to the end plate, the second bumper bracket comprising a rubber bumper configured to engage the support body when the handle is pulled backwards.

6. The personal sex toy of claim 1, wherein the handle comprises a vertical handle support coupled to the first end of the sliding rod, and a horizontal handle support adjustably coupled to the vertical handle support.

7. The personal sex toy of claim 6, wherein an angle between the vertical handle support and the sliding rod is adjustable and the angle between the vertical handle support and the horizontal handle support is adjustable.

8. The personal sex toy of claim 7, wherein the vertical handle support and the horizontal handle support each comprise a plurality of openings, wherein threaded arm knobs run through aligned openings of the horizontal handle support and the vertical handle support.

9. The personal sex toy of claim 1, further comprising front and rear leg couplers each comprising:

outer horizontal arms each comprising first ends and second ends; and a central support, wherein the first ends of the outer horizontal arms are fixedly adjustable along a length of the central support, and the second ends of the outer horizontal arms are fixedly adjustable along the length of a corresponding vertical leg of the vertical legs.

10. The personal sex toy of claim 9, wherein the outer horizontal arms and the plurality of vertical legs each comprise a plurality of openings, wherein threaded arm knobs run through aligned openings of the outer horizontal arms and the plurality of vertical legs.

11. The personal sex toy of claim 1, further comprising a phallic member releasably coupled to the end plate.

* * * * *